US007263029B2

(12) United States Patent
Jackson et al.

(10) Patent No.: US 7,263,029 B2
(45) Date of Patent: Aug. 28, 2007

(54) SYSTEM AND METHOD FOR ACQUIRING SEISMIC AND MICRO-SEISMIC DATA IN DEVIATED WELLBORES

(75) Inventors: James C. Jackson, Houston, TX (US); Neil E. Peake, Houston, TX (US); Les A. Morrison, Peterhead (GB); Jorn Andre Carlsen, Esbjerg V. (DK); Jose Rene Casarsa, Houston, TX (US); Jesse J. Constantine, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 244 days.

(21) Appl. No.: 10/421,518

(22) Filed: Apr. 23, 2003

(65) Prior Publication Data

US 2004/0017730 A1 Jan. 29, 2004

Related U.S. Application Data

(60) Provisional application No. 60/375,463, filed on Apr. 25, 2002.

(51) Int. Cl.
*G01V 1/40* (2006.01)

(52) U.S. Cl. ..... 367/25; 367/911; 181/102; 166/250.01

(58) Field of Classification Search ..... 367/25, 367/35, 86, 911; 175/50; 166/254.2, 250, 166/250.01; 181/102, 105
See application file for complete search history.

(56) References Cited

U.S. PATENT DOCUMENTS 5,016,727 A * 5/1991 Wittrisch ..... 367/25
5,255,245 A * 10/1993 Clot ..... 367/25
5,503,225 A * 4/1996 Withers ..... 166/250.1
5,662,165 A 9/1997 Tubel et al.
5,730,219 A 3/1998 Tubel et al.
5,801,642 A 9/1998 Meynier
6,131,658 A * 10/2000 Minear ..... 166/250.01
6,192,988 B1 2/2001 Tubel
6,209,640 B1 4/2001 Reimers et al.
6,253,848 B1 7/2001 Reimers et al.
6,302,204 B1 10/2001 Reimers et al.
6,325,161 B1 * 12/2001 Havig ..... 166/250.01
6,712,141 B1 * 3/2004 Bussear et al. ..... 166/250.17
6,736,213 B2 * 5/2004 Bussear et al. ..... 166/375
2003/0131997 A1 * 7/2003 Chatterji et al. ..... 166/278
2003/0218939 A1 * 11/2003 Casarsa et al. ..... 367/35

FOREIGN PATENT DOCUMENTS

GB 2356209 A 5/2001
GB 2356209 * 5/2004
WO WO 03/042498 A1 * 5/2003

* cited by examiner

*Primary Examiner*—Ian J. Lobo
(74) *Attorney, Agent, or Firm*—Madan, Mossman & Sriram, P.C.

(57) ABSTRACT

Methods and apparatus are adapted for acquiring seismic data from an array of sensors deployed along a section of a deviated, including horizontal, wellbore for monitoring seismic and microseismic activity. The sensors may be permanently deployed in the wellbore.

14 Claims, 3 Drawing Sheets

4
CONTROLLER
10
7
5
2
14
20
17
30
15
32
12
30
15
32
24
3

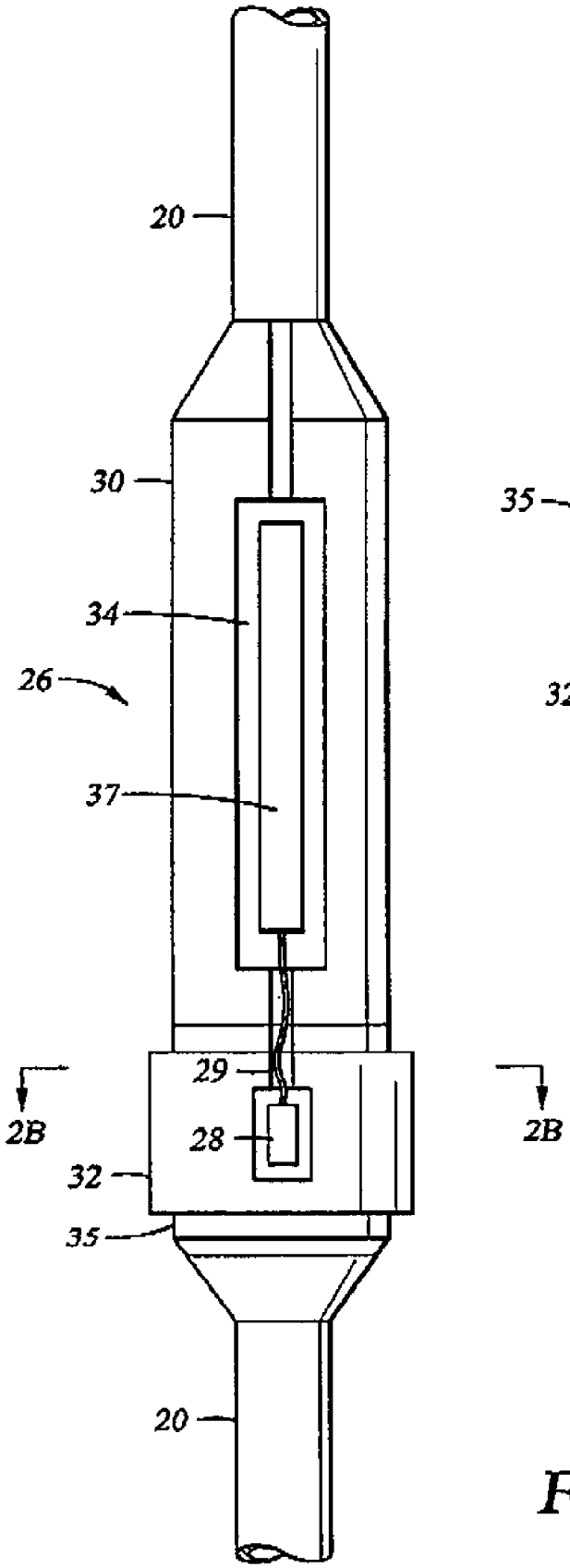
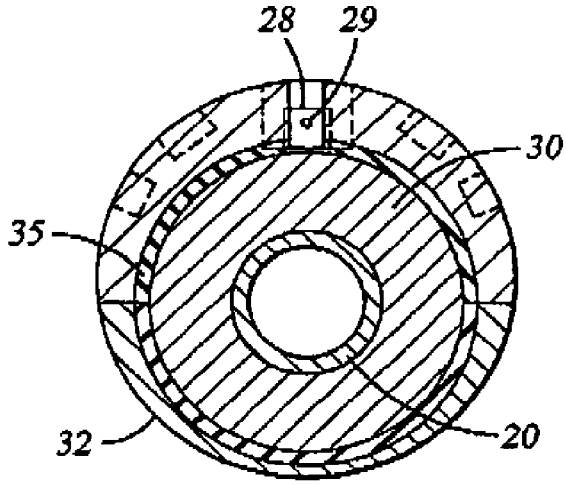
Fig. 2B
Fig. 2A

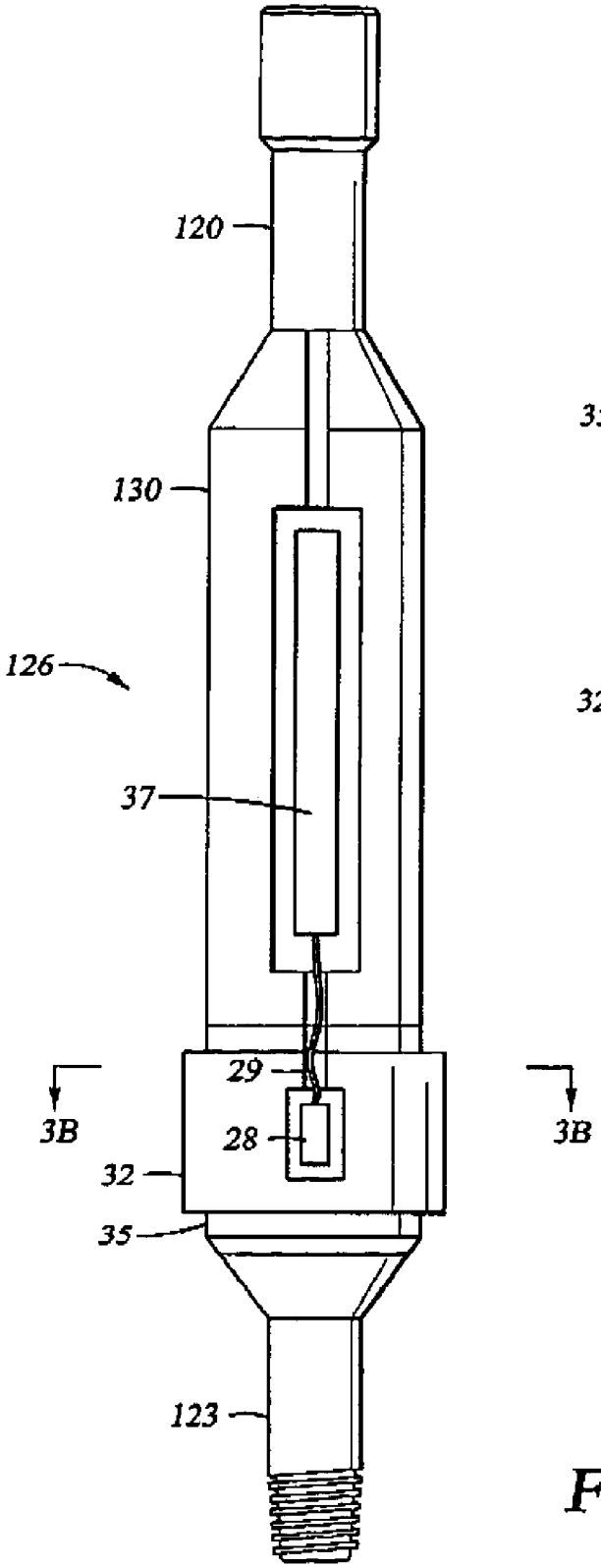
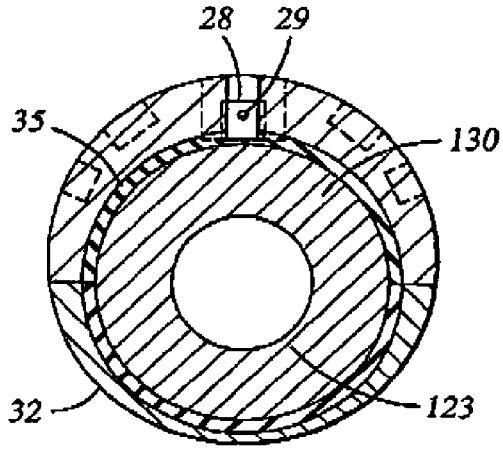
Fig. 3B
Fig. 3A

SYSTEM AND METHOD FOR ACQUIRING SEISMIC AND MICRO-SEISMIC DATA IN DEVIATED WELLBORES

CROSS-REFERENCE TO RELATED APPLICATIONS

This application claims the benefit of U.S. Provisional Application No. 60/375,463, filed Apr. 25, 2002.

STATEMENT REGARDING FEDERALLY SPONSORED RESEARCH OR DEVELOPMENT

Not applicable

BACKGROUND OF THE INVENTION

1. Field of the Invention

This invention relates to downhole seismic services and more particularly to a system and method for deployment, mounting, and coupling of seismic sensors downhole.

2. Description of the Related Art

Seismic sources and sensors are often deployed in wellbores for a variety of oilfield operations, including monitoring of injection well operations, fracturing operations, performing "seismic-profiling" surveys to obtain enhanced subsurface seismic maps and monitoring downhole vibrations. Such operations include slim-to large-diameter boreholes, vertical to horizontal wells, open and cased holes, and high pressure and high temperature wells. Downhole sensors are sometimes utilized in combination with other logging services, either wireline, coiled tubing-conveyed, or with pipe to provide additional reservoir information.

Seismic sensors deployed in wellbores are particularly useful to monitor fracturing and injection well operations, to generate cross-well information and to obtain seismic measurements over time, to obtain enhanced subsurface maps and to improve reservoir modeling. As used herein, seismic data refers to seismic signals generated by conventional surface or subsurface active seismic sources and to microseismic signals generated by formation fracturing. The majority of seismic data gathering is accomplished by wireline methods or by deploying seismic sensors such as geophones on coiled tubing or production pipe. Multicomponent geophones are usually preferred for such applications. An example is the classical three (3) axis geophone which detects particle motion in three mutually orthogonal directions (x, y and z directions).

Coupling of the geophone/accelerometer elements to the formation via the casing/liner is a critical issue for the acquisition of microseismic energy around a sensor location. It is key to the processing of microseismic information that a particular microseismic event can be seen, and properly characterized, at multiple levels of the sensor string. Thus it is critical that sensor/formation coupling should be consistent from level to level. If the seismic event is not similar, in terms of amplitude, phase and frequency, from level to level, event identification and characterization (e.g. P-wave vs. S-wave) will prove difficult to impossible.

It is desired that the seismic sensors should be in a consistently coupled from level to level. Microseismic events are low amplitude and high frequency and are therefore extremely vulnerable to noise. Identification depends on being able to compare the signals from level to level, requiring that geophone placement is as consistent as possible.

Seismic coupling of the sensors to the formation is a major problem with prior art permanent and semi-permanent seismic sensors arrays for detecting seismic and microseismic events in deviated wellbores. As used herein, the term "deviated" is defined to mean all wellbores inclined from the vertical and includes horizontal wellbores. In vertical wellbores bow-spring technology, where the sensors are commonly held against the wall by the bow-spring, can be used to couple the sensors to a casing or liner that is coupled to the formation by cement. The bow-spring acts to decouple the sensors from the mass effects and vibration effects of the tubing, providing good frequency response. In deviated wellbores, bow-springs can not support the relatively heavy weight of the conveying tubulars. Difficulties in obtaining consistent sensor coupling and/or response can result. For example, if the sensor carrying bow-spring is oriented to the bottom of the hole, the weight of the tubing may be coupled to the sensor causing resonance/noise problems and reduced frequency response. If the sensor carrying bow-spring is oriented toward the high side of the hole, the sensor may be only lightly forced against the wall or it may not even contact the wall. The use of bow springs to couple multiple spaced apart sensors to the wellbore in deviated wellbores requires that the bow springs be oriented the same to provide substantially uniform coupling. Pipe or tubing that has been rotated during insertion in the deviated well bore may have latent rotational torque in the tubing causing rotational misalignment of initially aligned sensors. In addition, coiled tubing has a natural torque and tends to corkscrew in the wellbore providing unpredictable coupling.

When the wellbores are vertical and susceptible to cement injection, the sensors may be cemented in place to provide and effective acoustic coupling with the formation structure. However, seismic sensor coupling to the formation structure by means of cementing may be precluded in deviated, including horizontal, wellbores due to the type of completion used. For example, seismic acquisition may be desired in an open-hole section of a long horizontal wellbore.

Thus there is a need for an apparatus and method for deploying permanent seismic sensors in deviated wellbores and ensuring that the sensors are consistently seismically coupled to the wellbore.

SUMMARY OF THE INVENTION

The methods and apparatus of the present invention overcome the foregoing disadvantages of the prior art by providing a carrier coupled to the tubular string wherein the seismic sensors are seismically coupled to the formation but substantially vibrationally isolated from the tubing.

In one aspect, a system for acquiring seismic data in a deviated wellbore in a formation, comprises a first tubular member disposed in the deviated wellbore. The first tubular member is coupled to the formation. A second tubular member is disposed in the first tubular member with an annular space between the second tubular member and the first tubular member. At least one sensor is disposed on the second tubular member such that the at least one sensor is acoustically coupled to the first tubular member and substantially vibrationally decoupled from the second tubular member.

In another aspect, a method of seismically coupling an array of seismic sensors to a formation surrounding a deviated wellbore comprises coupling a plurality of seismic wave transmitting centralizers to an exterior surface of a first tubular member at first predetermined locations along the first tubular member tube. A plurality of vibrationally isolated seismic sensors are located on an exterior surface along the length of a second tubular member at second predetermined locations along the second tubular member. The first tubular member is placed within the deviated wellbore. The second tubular member is placed within the first tubular member such that the seismic sensors are acoustically coupled to the first tubular member.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein:

FIG. 2A is a schematic of a seismic sensor assembly according to one embodiment of the present invention;

FIG. 2B is a sectional view of FIG. 2A;

FIG. 3A is a schematic of a seismic sensor assembly according to another preferred embodiment of the present invention; and FIG. 3B is a sectional view of FIG. 3A.

DESCRIPTION OF PREFERRED EMBODIMENTS

Figure 1:
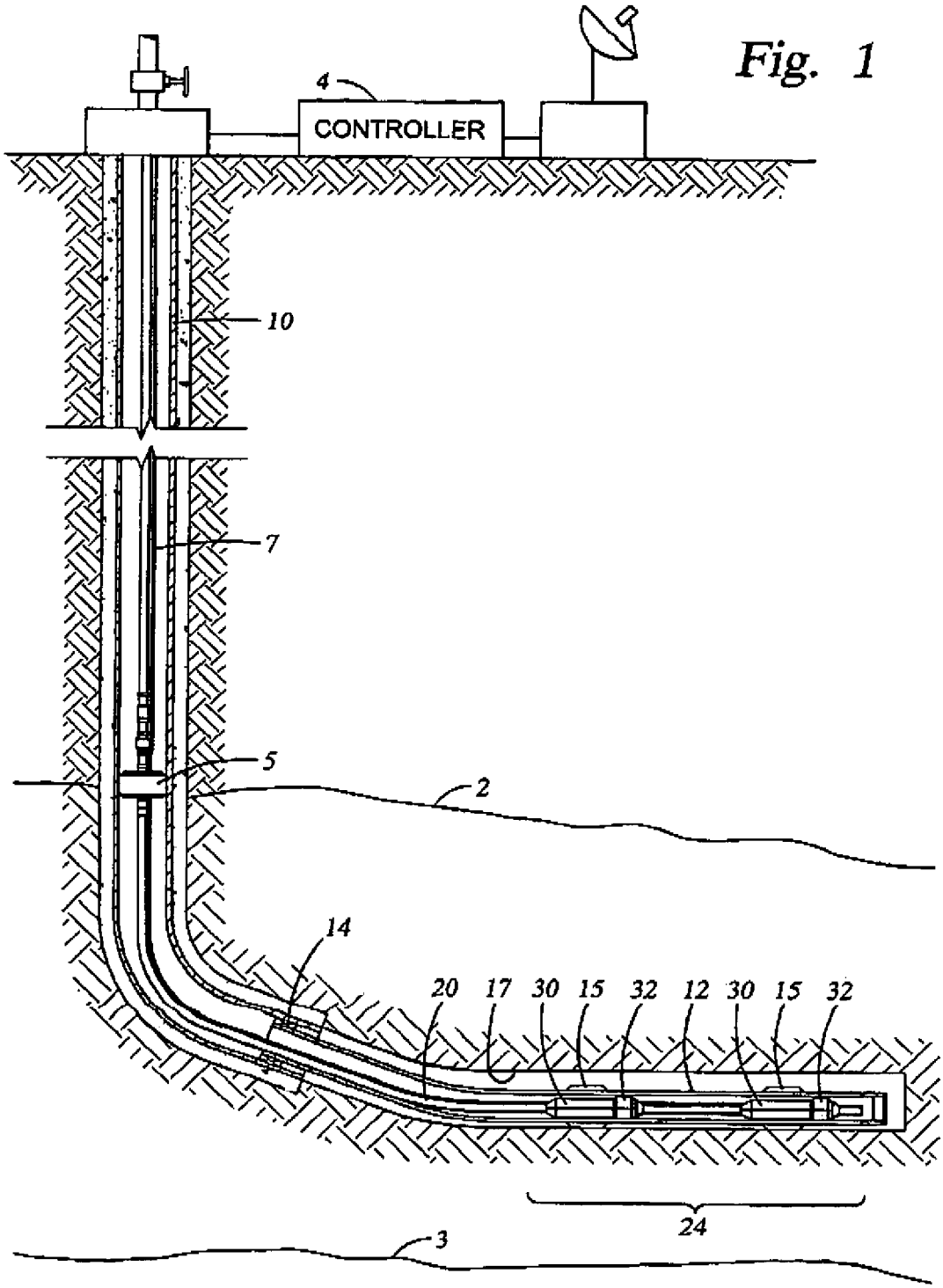
FIG. 1 is a schematic of a seismic system according to one embodiment of the present invention.

One preferred embodiment of the invention is represented schematically by FIG. 1 and comprises a wellbore casing 10 that is customarily secured to the wall of the surrounding wellbore 17 by cement. Near the bottom end of the casing 10, a slotted or perforated well liner 12 is secured to the inside wall of the casing 10 by means of a liner hanger/packer 14. The slotted liner 12 may be a formation fluid production screen of any suitable form. The slotted liner 12 may be extended beyond the bottom end of the casing between horizontal bedding planes 2,3 of a petroleum production formation or a water injection strata, for example.

The slotted liner 12 includes a plurality of centralizers 15 at predetermined locations along the liner length. These centralizers 15 may consist of longitudinally or helically aligned fins (not shown) that are intimately secured to the liner 12 outer surface. These centralizing fins 15 are structurally sufficient to support the liner weight along a substantially horizontal formation boring. Additionally, the centralizing fins 15 should make intimate support contact with the wellbore 17 wall to provide a acoustic coupling with the formation.

A seismic sensor array 24 comprising multiple seismic sensor carrier assemblies 26 (see FIGS. 2A, 2B) is disposed on the external surface of tubing 20 and the tubing 20 has sufficient buckling strength to be pushed into position along the inner bore of the slotted liner 12. The seismic sensors 28 may be any type of suitable seismic sensor for sensing seismic energy transmitted through the formation. These include, but are not limited to, geophones and accelerometers. Multi-axis sensors are preferred. Such devices are commercially available and will not be discussed further. The seismic sensors 28 are positioned in the annular space between tubing 20 and liner 12 with longitudinal spacing that substantially corresponds with the spacing between the plurality of liner centralizers 15. Each of the sensors 28 is secured at the predetermined location to a carrier assembly 26 that is attached to the tubing 20. The sensors 28 may be permanently deployed.

In one preferred embodiment, the carrier assembly 26, see FIGS. 2A, 2B, comprises a split housing 30 having an internal bore sized to tightly clamp over tubing 20 using mechanical fasteners such as threaded bolts (not shown). Such techniques are known in the art. Because of the split nature of the housing 30, the tubing 20 may be coiled tubing or threaded tubing, both of which are known in the art. The housing 30 has a recess, or cavity, 34 in an outer surface to accept an electronics module 37. Electronics module 37 has power and sensor interface circuits, a processor with memory, and communications circuits to receive signals from sensors 28 and transmit the signals to a surface controller 4 via communications cables 7. The received seismic signals may be transmitted in real-time to the surface controller 4 or may be stored in downhole memory for later transmission to the surface. The electronics module is connected to the sensors 28 via cable 29. As shown in FIGS. 2A, 2B, a compliant isolator sleeve 35 is attached to one end of the carrier housing 30. A split cylindrical sensor housing 32, also called a sensor ring, is clamped around the isolator sleeve 35 using mechanical fasteners (not shown). The geophone sensors 28 are mounted on the sensor housing 32. The sensor housing 32 is sized so that the outer diameter of the sensor housing 32 is approximately the same as the inside diameter of the liner 12 allowing only enough clearance to ensure that the seismic array can be pushed through the liner. This ensures that the weight of the tubing 20 will be sufficient to cause the sensor housing 32 to contact the low side of the liner 12 in the deviated wellbore 17 thereby acoustically coupling the sensor housing 32 through the liner 12 to the formation. Note that the cylindrical housing 32 acoustic coupling to liner 12 is insensitive to tubing 20 alignment because the housing 32 provides the same geometrical contact to the liner 12 at any rotational alignment of the tubing 20.

In operation, in one preferred embodiment, the sensor housings 32 are spaced to substantially coincide with the locations of the centralizers 15 thereby providing acoustic coupling to the formation through the centralizers 15. Alternatively, in another preferred embodiment, the centralizers 15 are spaced sufficiently apart, for example several hundred feet, such that the liner 12 lays on the bottom of the wellbore 17 thereby providing acoustic coupling to the formation through the liner 12. The sensor housings 32 may be positioned at any position along the section of tubing 20 in contact with the liner 12.

The isolator sleeve 35 is typically made out of a compliant material, for example an elastomer such as a rubber compound, and acts to vibrationally isolate the tubing 20 from the sensor housing 32. Any compliant material may be used for the isolator sleeve 35. As is well known, even hard rubbers of 90-95 Shore A durometer have an elastic modulus of only several thousand pounds per square inch as compared to steel that has an elastic modulus on the order of thirty million pounds per square inch. Thus, the rubber isolator acts to isolate the movement of the sensor housing 32 from movement of tubing 20. In addition, this enables the sensor housing 32 to present a substantially smaller apparent mass to the seismic energy than if the sensor housing 32 were solidly attached to the tubing 20. This results in the sensor system having better sensitivity and a broader frequency response for receiving the seismic signals than if the sensor housing 32 was solidly coupled to the tubing 20.

Communications cables 7 may be electrical cables, fiber optic cables, or a combination of such cables. The communications cables may be run in a separate tube such as the Tubing Encased Conductor system commercially available from Baker Hughes, Inc., Houston, Tex.

The communications cables 7 are connected to a surface controller 4 for controlling the seismic data acquisition process. The controller can be programmed to operate seismic sources (not shown) for generating seismic signals to be received by the array 24. The controller 4 according to programmed instructions, can receive, process, and store signals locally from the array 24. Alternatively, the controller 4 can be programmed to telecommunicate the received signal in either raw or processed format to a remote location.

In another preferred embodiment the array 24 is made up of multiple threaded assemblies, shown in FIGS. 3A, 3B. The carrier housing 130 and threaded tubing sections 120 and 123 are fabricated as a single integral piece. The assemblies are threaded together or to bare tubing sections as spacers to position the sensors near the spacers 15 as described previously. The rest of the system is as described previously.

One skilled in the art will appreciate that the present invention is useful in deviated wellbores, which include horizontal wellbores.

While described above for use with a liner, the system as described above is equally suitable for use in a casing in a deviated wellbore.

In an alternative preferred embodiment (not shown), the tubing 20 and sensor array system 24 as described above may be run directly into an open-hole section of a deviated wellbore. The weight of the tubing will cause the sensor housings to contact the wall of the wellbore thereby establishing acoustic coupling.

The system is installed in the wellbore using techniques known in the art for installing intelligent completion systems.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A system for acquiring seismic data, the system comprising:

a first tubular member disposed in a deviated wellbore, the first tubular member coupled to a formation surrounding the deviated wellbore;

a plurality of centralizers disposed on an outer surface of the first tubular member for spacing the first tubular member away from the deviated wellbore;

a second tubular member disposed in the first tubular member with an annular space between the second tubular member and the first tubular member; and at least one sensor disposed on the second tubular member in the annular space such that the at least one sensor is acoustically coupled to the first tubular member by the weight of the second tubular member and substantially vibrationally decoupled from the second tubular member.

2. The system of claim 1, wherein the at least one sensor is housed in a sensor carrier assembly, the sensor carrier assembly including:

a housing adapted to attach to an outer periphery of the second tubular member, the housing having a cavity adapted to contain an electronics module;

a compliant acoustic isolator attached to an outer periphery of the housing; and a sensor housing disposed around the compliant acoustic isolator, the sensor housing adapted to house the at least one sensor.

3. The system of claim 1, wherein the at least one sensor is a seismic sensor.

4. The system of claim 2, wherein the compliant acoustic isolator is made of an elastomeric material.

5. The system of claim 3, wherein the seismic sensor is one of (i) a three axis geophone and (ii) a three axis accelerometer.

6. The system of claim 1, wherein the at least one sensor is pennanently disposed in the wellbore.

7. A method of seismically coupling an array of seismic sensors to a formation surrounding a deviated wellbore, comprising;

coupling a plurality of centralizers to an exterior surface of a first tubular member at first predetermined locations along the first tubular member;

locating a plurality of vibrationally isolated seismic sensors on an exterior surface along a length of a second tubular member at second predetermined locations along the second tubular member;

placing the first tubular member within the deviated wellbore; and placing the second tubular member within the first tubular member such that the seismic sensors are acoustically coupled to the first tubular member.

8. The method of claim 7, wherein the second predetermined locations align with the first predetermined locations when the second tubular member is placed in the first tubular member.

9. The method of claim 7, wherein the plurality of centralizers are spaced apart such that the first tubular member is acoustically coupled to the formation.

10. The method of claim 9, wherein the plurality of the seismic sensors are spaced such that they align with the first tubular member where the first tabular member contacts the formation.

11. The method of claim 7, wherein each of the plurality of the seismic sensors is coupled to the second tubular member through an acoustic isolator.

12. The method of claim 11, wherein the acoustic isolator is a compliant sleeve.

13. The method of claim 7, wherein at least one of the plurality of the seismic sensors is one of (i) a three axis geophone and (ii) a three axis accelerometer.

14. The method of claim 7, wherein each of the plurality of the seismic sensors is housed in a substantially cylindrical housing.

* * * * *